US011344783B2

(12) United States Patent
Procopis

(10) Patent No.: US 11,344,783 B2
(45) **Date of Patent: *May 31, 2022**

(54) GOLF TRAINING AID

(71) Applicant: Anthony Procopis, Palmwoods (AU)

(72) Inventor: Anthony Procopis, Palmwoods (AU)

( * ) Notice: Subject to any disclaimer, the term of this patent is extended or adjusted under 35 U.S.C. 154(b) by 0 days.

This patent is subject to a terminal disclaimer.

(21) Appl. No.: 16/888,532

(22) Filed: May 29, 2020

(65) Prior Publication Data

US 2021/0086055 A1 Mar. 25, 2021

Related U.S. Application Data

(63) Continuation of application No. 16/275,351, filed on Feb. 14, 2019, now Pat. No. 10,695,641.

(60) Provisional application No. 62/630,849, filed on Feb. 15, 2018.

(51) Int. Cl.
*A63B 69/36* (2006.01)
*A63B 57/19* (2015.01)

(52) U.S. Cl.
CPC ..... *A63B 69/3621* (2020.08); *A63B 57/19* (2015.10)

(58) Field of Classification Search
CPC ..... A63B 69/3621; A63B 57/19
USPC ..... 473/252, 257, 258, 261, 262, 264, 265, 473/266, 273
See application file for complete search history.

(56) References Cited

U.S. PATENT DOCUMENTS 3,166,326 A * 1/1965 Mundy, III ..... A63B 69/3676 473/265
3,482,838 A 12/1969 Gibson
3,870,315 A * 3/1975 Lawlor ..... A63B 69/3621 473/264
4,927,152 A 5/1990 Graham
5,275,570 A 1/1994 Hicks
5,443,265 A * 8/1995 Wheeler ..... A63B 69/3676 473/257
6,019,685 A * 2/2000 Fonseca ..... A63B 69/36211 473/265
D436,639 S 1/2001 Haliyo
6,840,870 B1 * 1/2005 Froggatte ..... A63B 24/0003 473/265
7,214,140 B2 5/2007 Coombs
7,431,661 B1 10/2008 Cailey
(Continued)

OTHER PUBLICATIONS

Eyeline Golf Speed Trap, by Eyeline Golf, available from Amazon.com at https://www.amazon.com/EyeLine-Golf-Speed-Carry-Eliminate/dp/B013SLXCTS, date unknown.

(Continued)

*Primary Examiner* — Nini F Legesse

(57) ABSTRACT

A golf training aid helps train a correct golf swing path where for a short period of time, the club is swung straight through the ball and down the target-line for a period of 12 inches, 6 inches before and 6 inches after impact. The golf training aid golfers achieve this flat with all golf clubs. Four six-inch angled polymer poles attach to a base made for driver and wood shots off a tee, and iron and wood-shots off the ground. Feedback is provided when a player hits or misses the poles. Angled poles are fixed to the base's external driver and iron lines for use with the various clubs, and the ball is aligned with one of two center lines, one line being for tee-shots and the other being for shots hit from the ground.

16 Claims, 2 Drawing Sheets

(56) References Cited

U.S. PATENT DOCUMENTS

| | | | | |
|---|---|---|---|---|
| 8,696,485 | B2 * | 4/2014 | Pies | A63B 69/3621 473/265 |
| 9,089,757 | B2 * | 7/2015 | O'Donovan | A63B 71/06 |
| 10,695,641 | B2 * | 6/2020 | Procopis | A63B 57/19 |
| 2003/0148815 | A1 * | 8/2003 | Swistock | A63B 69/3676 473/257 |
| 2014/0335969 | A1 * | 11/2014 | Ellington | A63B 69/3621 473/257 |

OTHER PUBLICATIONS

2019 New Golf Speed Trap Swing Trainer, available on Alibaba.com at https://www.alibaba.com/product-detail/2019-New-Golf-Speed-Trap-Wholesale_60681071660.html, date, unknown.

Cameron Strachan, "How a Frustrated 30 Year Old Golf Rogue . . . Perfect Golf Swing Training System" at the Golf GooRoo: https://www.golfgooroo.com/swing-trainer-fsp/.

You Tube Video (https://www.youtube.com/watch?v=t9WtzpP2Ywo), titled: How to Make Clean Contact & Stop Chunking Golf Shots / The Speed Trap. Published on Apr. 28, 2017.

You Tube Video (https://www.youtube.com/watch?v=9dx2Pg5ZE7s), titled: Eliminate the Driver Slice with the Speed Trap. Published on Sep. 4, 2017.

You Tube Video (https://www.youtube.com/watch?v=9dx2Pq5ZE7s), titled: Speed trap Golf & Slot It Golf Swing Trainers Comparison . . . Woods & Irons, Published on Aug. 21, 2018.

* cited by examiner

GOLF TRAINING AID

The present application is a continuation of U.S. patent application Ser. No. 16/275,351, filed on Feb. 14, 2019 which claims the benefit of domestic priority based on U.S. Provisional Patent Application 62/630,849 filed on Feb. 15, 2018, the entireties of both of which are incorporated herein by reference.

BACKGROUND OF THE INVENTION

Field of the Invention

The invention relates generally to a golf training aid to help golfers achieve the correct angle-of-attack (steepness) and straight swing-path six inches immediately before and six inches immediately after impact with the ball.

Background

Currently there are a few solutions for golfers to practice swinging on the correct swing plane/path. These solutions attempt to give a one-size fit all prescription—despite golfers possessing differences in rhythm, height, coordination and natural tendencies, differences that are even common among masters of the game.

The first one-size-fits-all category are the full swing-plane aids where the golfer swings on or against an angled sphere for the entire swing. This one-size-fits-all prescription can ruin positive natural tendencies such as a player's rhythm, tempo and how the player naturally gathers and applies energy. Many World class players do not swing on this perfect swing-plane, they swing above or below, they dip or stand up fractionally when they swing. That said, they all have one crucial swing phenomena in common: a straight flat swing-path just prior and past the ball (the path becomes steeper the shorter the club being used). Furthermore, these full swing aids are heavy, cumbersome, expensive, can't be transported easily and they are not made to be used when actually attempting to hit a golf ball, rather, they are used for practicing positions in a practice swing without hitting.

Other solutions attempt to counter the cumbersome universal swing prescription by using a light weight portable base with light weight poles with the goal of grooving a straight swing-path and correct angle-of-attack just prior and past impact with the ball, thereby, the player utilizes his/her natural swing and rhythm. The problem with these training aids is that they are designed for practice with 7-irons swinging on a 62.5-degree angle (the shaft lie-angle of a standard 7-iron at address and impact). There is however some give in the shallowness of the angle a player can swing through the poles successfully and not hit the poles, meaning, an accomplished player can swing through with an angle of a 4-iron (60 degree lie-angle). (These angles vary slightly with the height of players and respective arm and torso lengths; however, this does not significantly impact the use.)

There are problems with this limited swing-angle range, such as: (1) all levels of golfers are beholden to practice with only 6 or 7 irons—up to wedges (only highly skilled players can practice with 4 iron up to wedge). Clubs such as long irons, fairway woods, hybrids and the driver cannot be used in the same way as with the mid to high irons (hitting between the four poles down the target line) as the solutions are not designed for use with both irons and woods (it doesn't have the: width of base, lines on the base, or the angled poles needed for use with a big headed driver and other woods).

Great players over the years have practiced with all clubs—and this can be seen at every Professional golfer's tournament—on the practice fairway. And specifically, the inventor achieved a professional swing level by practicing for hundreds of hours with a driver—as well as other clubs. Outside of the putter, no golf club is used as much in a round of golf as the driver. The driver is the most powerful and dangerous club; the driver used well, can hit the ball long and straight and set up hole after hole for low scoring, and negatively, it can send the golfer's ball wayward into the water, trees and other hazards. (The driver, more than any other club, imparts more side-spin and less backspin on the ball, therefore, poses greater risk for sideways ball curvature (hooks and slices); it needs to be practiced correctly and mastered to harness its power into straight long drives.)

For the reasons mentioned, this training aid and its flexible options is an improvement on anything that has come before it; it is inexpensive, portable, durable, and most importantly, the golfer can keep their natural rhythm and idiosyncrasies while mastering the straight, flat swing-path with all clubs that accomplished swingers achieve at the bottom of their swings.

It would be desirable to have a device that helps golfers master their swings with the driver, woods and irons so as to achieve a straight, perfectly angled swing when hitting through the ball. Similar portable devices with small foam or plastic poles can only be used on angled swings that are no less than 62.5 degrees approximately—the angle of a 7-iron. Using the same device and poles for iron play does not work with a big headed, flat angled driver that is swung through impact on an angle of between 44 to 50 degrees (or with fairway woods and hybrids). Top players practice with all their clubs to achieve mastery.

The present invention, currently embodied commercially as the Slot It Golf Swing-Trainer helps amateurs improves their golf swings for all angled clubs via the use of: 1) different angled woods and irons poles placed on 2) exterior lines for woods and irons, and 3) centered alignment/target-lines for striking the ball from the ground and when striking the ball from a tee.

SUMMARY

Disclosed is a golf training aid currently commercially embodied as the Slot It Golf Swing Trainer which is made up of the following components: a polycarbonate or similar material U-shaped base that is approximately 17 inches in length (44 cm); on the external parts of the base there are two parallel, horizontal lines and small perpendicular lines for placement of poles; there is a center alignment line/arrow between the poles for irons and wood shots hit off the ground; 56 mm either side of the center target line/arrow are lines/arrows for left and right handed shots with a driver; these lines are positioned as a guide line for the perfect impact with the ball between the center of the angled poles with the driver-face when the ball is hit from a tee, typically, 56 mm above the ground (typical impact elevation); the middle part of the base has a similar U-shape to iron-only devices but differs greatly in the dimensions of the U-shape; the space in the U starts at 70 mm, versus 245 mm of the iron-only bases. The ball is positioned in the center between the front and back poles at 6 inches (150 mm)—in line with the perpendicular side line; back from the center ball position mark there are two other perpendicular lines used to position chipping and pitching shots. Four 6-inch (150 mm) poles are placed on the external lines (two at the exit and two at the entry points); different sets of poles are used for teed up shots with woods (from 44 degrees up), or fairway woods and irons from the ground.

The device may also have one or more of the following: small foam or similar poles of varying angles between 44 and 65 degrees; this variation in angled poles is important as the angled sphere (swing-plane) that players swing on vary greatly between: a) players of different heights—even when using the same club, b) the club being used; the u-shaped base recess is at 70 mm of the 320 mm total "U" length, however, total length can be extended or decreased in manufacturing; 3) the width of the base can be widened or narrowed to change the width of the slot to swing through. Base dimensions, height and angle of poles (and material), target, exterior, and ball position lines, can all be extended, decreased or changed in manufacturing if desired.

The disclosed device is unique when compared with other known devices and solutions because it provides: (1) the ability for the user to practice the most important long range club in golf: the driver; (2) the ability for the user to practice using all the angled clubs from driver to wedge which encompass a range of 44 to 65 degrees; (3) the base's long U shaped recess (12 inches) and full-shot ball positioning lines, mirror and encourage practice and hitting from within the perfect Flat Spot slot; (4) all players can practice various swing-angles—regardless of their height; (5) the player can obtain instant feedback when using any club with the appropriate pole, this fosters adjustments and improvement; (6) the device is durable, inexpensive, personal, and portable.

The disclosed device is unique in that it is structurally different from other known devices or solutions. More specifically, the device is unique due to the presence of: (1) the base measurements mirror the flat spot (12 inches) at the bottom the of the swing that professional and accomplished amateurs swings pass through, and, practice can be done through practice swings and hitting balls (not just for practice swings only—as many devices are made for); (2) the u-shaped base recess cuts in at 70 mm of the 320 mm total length—making a hollow channel for hitting that is three times the recess/channel length and vastly different to any of the known iron-only bases available; (3) the poles are constructed at various angles for various clubs and heights of players; the poles are placed on either the long line closer to the center for ground shots or on the exterior line for teed-up shots; (4) the driver poles which are angled differently to the existing iron poles are rectangular in shape (they can be made rectangular, spherical or another shape) and where designed and created for the devise specifically; (5) internal target lines spaced 56 mm to the left and right side of center lines (for use by left or right handers) have been created to correspond mathematically with: the center of the driver-face (typical modern day big head) at impact when the ball is struck from a tee 56 mm above the ground, (typical height) and is the center position between the angled poles; 56 mm is the height of the ball teed half-a-balls-width above a the driver (most common teed-up height is a half-a-balls-width above the top of the driver); slight deviations including a higher or lower teed-up ball do not significantly impact on the integrity of this method.

Among other things, it is an object of the present invention to provide a portable, affordable and personal training device that lets golfers master hitting through the ball straight—with all clubs—the way masters skilled in the art do. These innovations are unique as they allow golfers of any height using any club to practice all swing-plane angles—unlike previous solutions.

The invention will now be described more fully hereinafter with reference to the accompanying drawings, which are intended to be read in conjunction with both this summary, the detailed description and any preferred and/or particular embodiments and variations specifically discussed or otherwise disclosed. This invention may, however, be embodied in many different forms and should not be construed as limited to the embodiments set forth herein; rather, these embodiments are provided by way of illustration only and so that this disclosure will be thorough, complete and fully conveys the full scope of the invention to those skilled in the art.

DESCRIPTION

The present invention is directed to a golf training aid to help golfers achieve the correct angle-of-attack and straight swing-path 6-inches immediately before and 6-inches immediately after impact with the ball.

Figure 1:
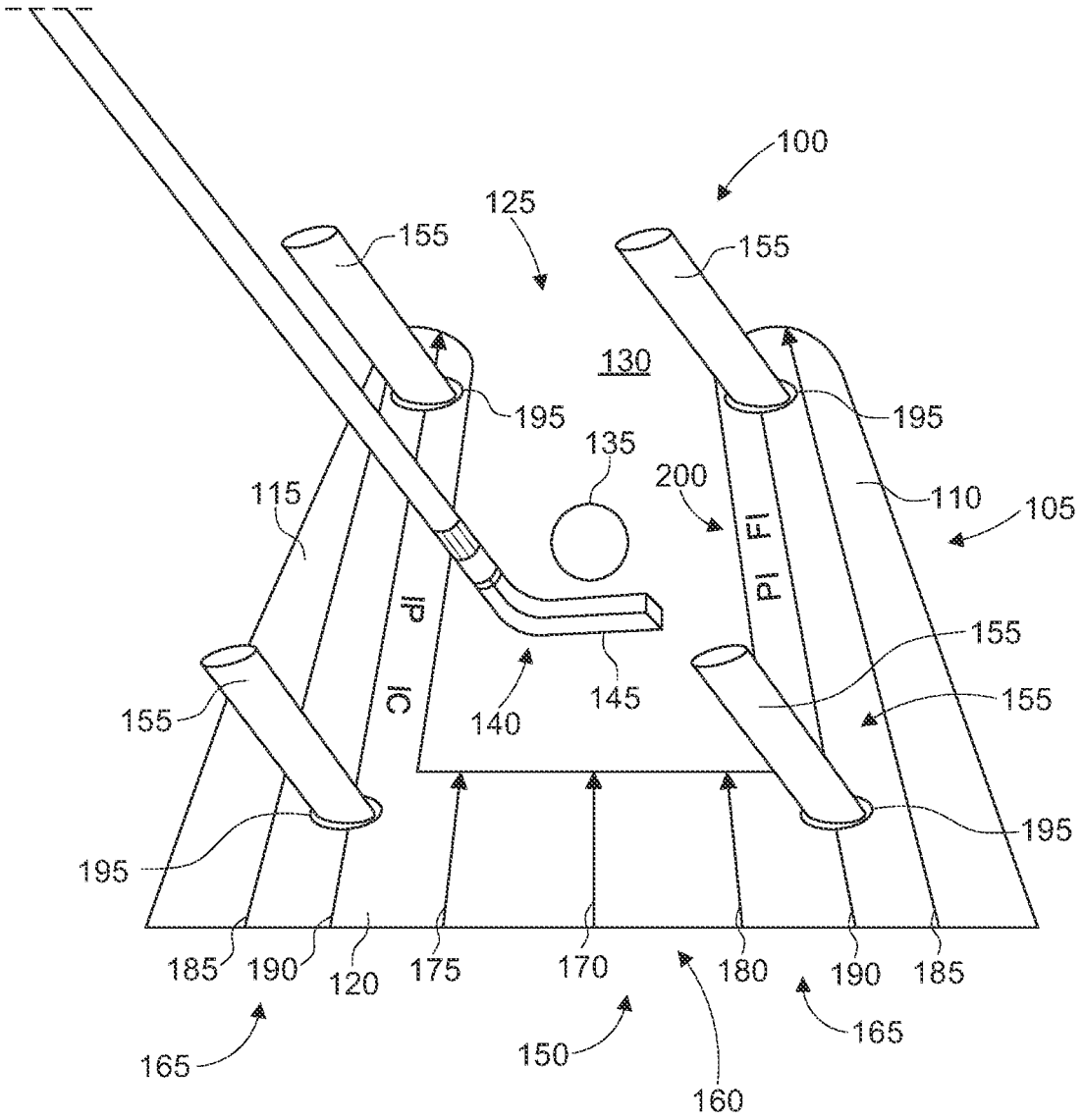
FIG. 1 is a schematic rear perspective view of a version of a golf training aid according to the invention set up for an iron shot, viewed down the target line.

A golf training aid 100 according to one version of the invention is shown in FIG. 1. The golf training aid 100 includes a base 105 having a flat and generally U-shape structure. The base 105 is made up of a first arm 110 and a second arm 115 extending parallel to the first arm 110. The first arm 110 and the second arm 115 are connected by a connecting portion 120 to form the U shape. Within the first arm 110, the second arm 115, and the connecting portion 120 is an open interior 125. When the base 105 is placed on the ground 130, the ground 130 can be exposed in the open interior 125 so that a ball 135 can be placed on the ground 130 within the open interior 125 of the base 105. A golf club 140, such as an iron 145 as shown in FIG. 1, can be swung by a user so that it can make contact with the ball 135 on the ground 130 in the open interior 125 of the base 105.

Figure 2:
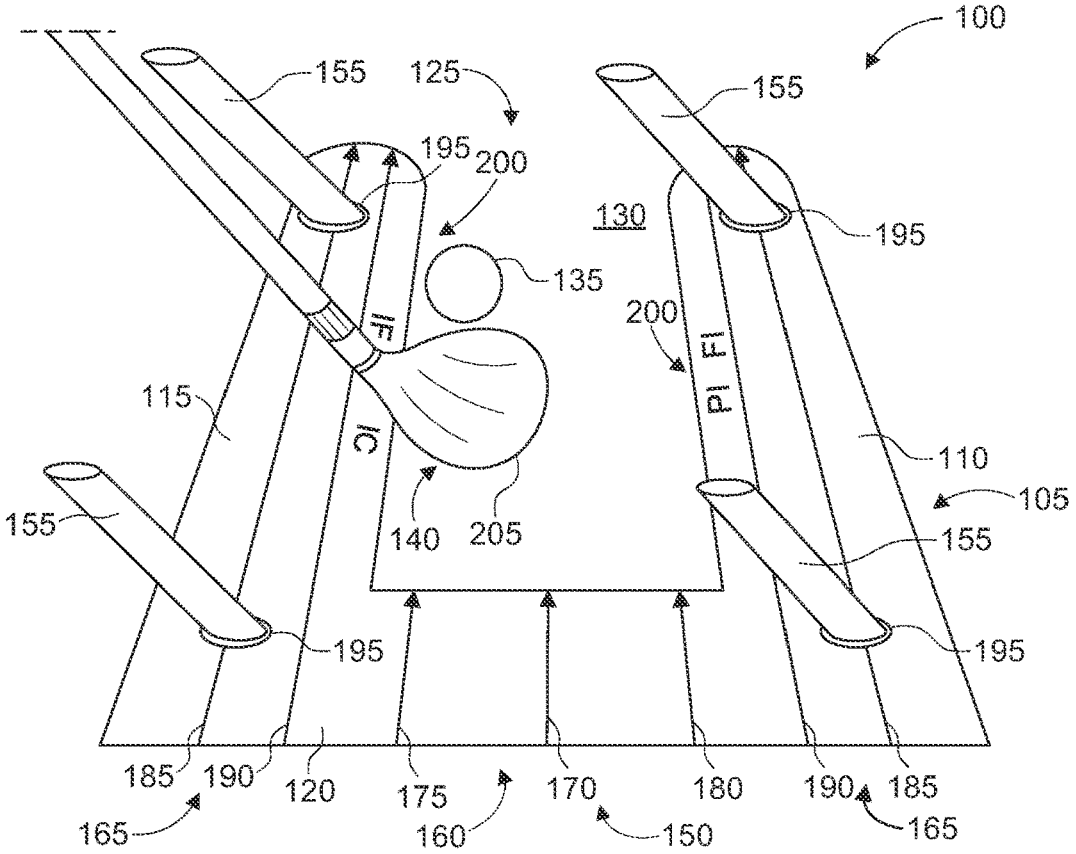
FIG. 2 is a schematic rear perspective view of a version of the golf training aid of FIG. 1 set up for a driver shot, viewed down the target line.

In one version, the golf training aid is made up of the U-shaped base 105, a plurality lines, such as straight lines or arrows, 150 on the U-shaped base 105, and a plurality of poles 155 positionable on the U-shaped base 105. The U-shaped base 105 may be made out of polycarbonate or similar material and may be a minimum of 12 inches (302 mm) in length between rear and front poles. The plurality of lines 150 includes target lines 160 and pole-positioning lines 165. The target lines 160 are located on the connecting portion 120. The target lines 160 include a center target line 170 for iron and woods/hybrid shots struck off the ground. As can be seen in FIG. 1, the ball 135 is placed on the ground 130 in the open interior 125 and positions along a line extending from the center line 170. The target lines 160 may also include a right-handed driver line 175 and a left-handed driver line 180 offset from the center line 170. The two driver target lines/arrows 175, 180 may be positioned 56 mm left and right of the center line 170 (for left and right hand players). The two driver target lines 175, 180 can also be used for other woods. The distance of 56 mm matches the correct impact position of the driver with the ball above the ground between the angled poles when hit off a tee, as will be discussed in connection with FIG. 2 below. The pole-positioning lines 165 include a pair of exterior lines 185 and a pair of interior lines 190 with one line of each pair located on the first arm 110 and one located on the second arm 115. The pair of exterior lines indicates the positioning of the poles 155 for driver and other wood shots off a tee, as shown in FIG. 2. The pair of interior lines 190 indicates the positioning of the poles 155 for iron or woods/hybrid shots stuck with the ball 135 on the ground 130, as shown in FIG. 1. The poles 155 are hittable foam/plastic/poly/EVA that are angled at an angle relative to the base 105 varying in degrees from 44 to 65 degrees. The poles 155 each have a base 195 having touch fasteners glued thereto that attach/fasten the poles 155 to the U-shaped base 105.

A method associated with the golf training aid 100 includes the following steps: (1) the golfer selects the club 140 he/she would like to practice with then selects and attaches to the base 105 the angled poles 155, two at the exit and two at the entry points, that most suits the club to be used; (2) the golfer attempts to progress by first swinging between the poles without a ball with a high angled club such as an iron 145, such as a 7-iron; once this is achieved the golfer practices swinging between the poles 155 and hitting balls 135; (3) the golfer then repeats this process with progressively less angled clubs and poles (44 to 65 degrees); and (4) to further test the golfers swing precision, the angled poles 155 can be placed closer together laterally on the touch fasteners, thereby making a narrower slot to swing through.

During the improvement process the golfer will hit the poles 155, this is fine as the poles 155 are made for impact; no damage is done to the golfer's club, minimal to the poles, and valuable kinesthetic feedback is obtained with every swing made—which results in swing adjustments and improvement.

Referring to FIG. 1, it can be seen that the pole positioning lines 165 run the length of golf training aid 100 on each side that the irons and woods poles 155 are placed on respectively. The poles 155 have enough width between left and right for a straight swing-path and well executed shot to be made without hitting either pole 155. The length of golf training aid 100 from pole to pole is 12.6 inches (320 mm) which is approximately this distance where a straight swing-path appears in a well-executed swing. This length can be lengthened or shortened in manufacturing. The center target line 170 shows the target line/arrow which is in the center between the poles 155 and acts a guide for iron and woods shots off the ground. FIG. 1 shows the poles 155 positioned on the interior lines 190 for iron or wood/hybrid shots hit from the ground (55 to 65-degree poles). The poles 155 may have adhesive strips on their bases 195 that attach to adhesive strips on the U-shaped base 105. Also provided on the U-shaped base 105 is a mark 200 to indicate the mid-point in the 12-inch slot that the player plays the ball from (although, the player can play from behind or in front of this spot, and the line can be changed in manufacturing if required).

FIG. 2 shows the golf training aid 100 for use with a driver or other wood 205 when hitting a ball 135 positioned on a tee (tee not shown). The angled poles 155 are designed at 48 degrees in the version shown, a typical shaft lie-angle at impact of an accomplished player is between 44 and 50 degrees (in manufacture this can be adjusted up or down for the driver and other clubs from 44 to 65 degrees). The poles 155 are placed on the external lines/arrows 185 (both sides), and may have an angle different than the poles used for irons as shown in FIG. 1. The right-handed driver line 175 shows the line on which the teed ball 135 is positioned for a right-handed player, and the left-handed driver line 180 shows the line on which the teed ball 135 is to be positioned for a left-handed player. These driver lines or arrows 175, 180 are 56 mm on either side of center target line 170. These driver lines or arrows 175, match the ideal center entry line and elevation at 56 mm above the ground 130 between the two poles 155 when hitting a driver. (This distance is calculated using the height of the average modern driver, plus half a ball's height—as teed-up above the driver, minus, the distance from the top of the driver to the center of the face where the ball is struck and the driver poles angle.)

Figure 3:
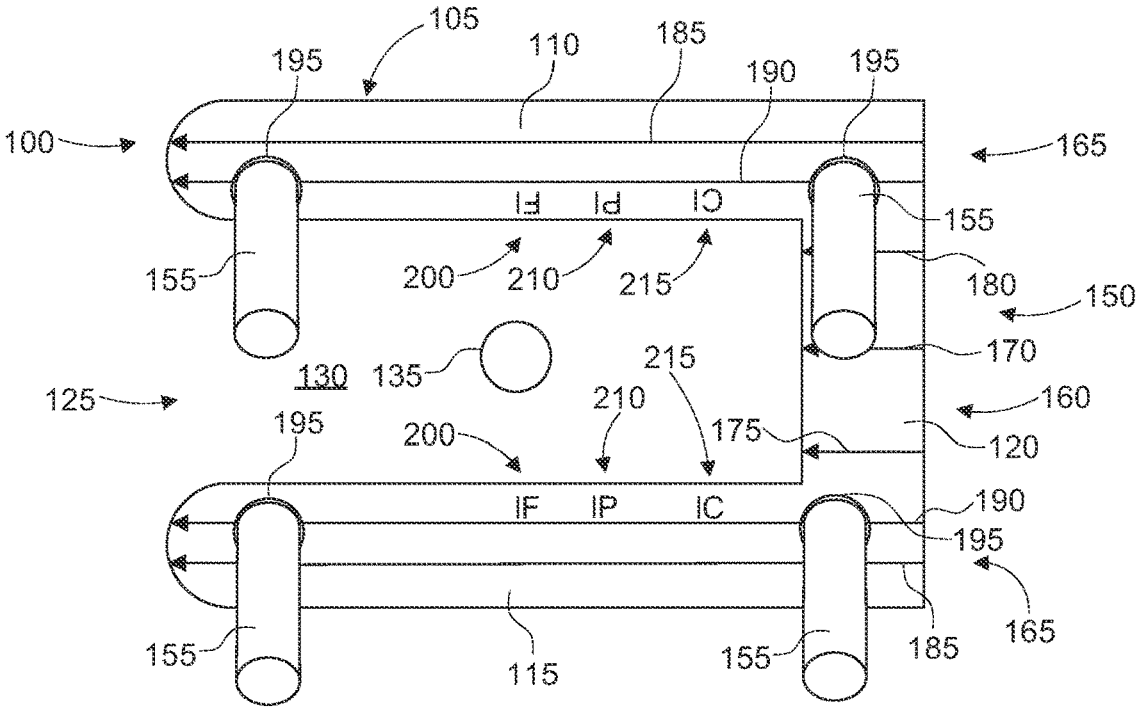
FIG. 3 is a schematic top view of the golf training aid of FIG. 1 set up for an iron shot.

FIG. 3 shows a top view of the golf training aid 100 in use as in FIG. 1. The width of the base 105 between the external poles and lines is currently 305 mm (with overhang on either side); this could be widened in future embodiments if a wider slot was required. FIG. 3 also shows the mark 200 to indicate the position of the ball 135. Additional marks, for example, a pitching mark 210 and a chipping mark 215 may be provided.

As discussed, the invention has many different features, variations and multiple different embodiments. The invention has been described in this application at times in terms of specific embodiments for illustrative purposes and without the intent to limit or suggest that the invention conceived is only one particular embodiment. It is to be understood that the invention is not limited to any single specific embodiments or enumerated variations. Many modifications, variations and other embodiments of the invention will come to mind of those skilled in the art to which this invention pertains, and which are intended to be and are covered by both this disclosure. It is indeed intended that the scope of the invention should be determined by proper interpretation and construction of the disclosure, including equivalents, as understood by those of skill in the art relying upon the complete disclosure at the time of filing.

The invention claimed is:

1. A golf training aid for practicing swings, the golf training aid comprising:

a U-shaped base having a first arm and a second arm parallel to the first arm, the first arm and second arm being connected at a connecting portion to form a U-shaped structure having an open interior between the first arm and the second arm so that when the base is placed on the ground, the ground is exposed within the open interior, and a plurality of poles, each pole having a base selectively attachable to the U-shaped base, wherein the U-shaped base includes a target line, a pair of external pole-positioning lines, and a pair of interior pole-positioning lines inside and parallel to the external pole-positioning lines, wherein the poles are attachable to the U-shaped base along the interior pole-positioning lines when swings are to be practiced and wherein the poles are attachable to the U-shaped base along the exterior pole-positioning lines when other swings are to be practiced.

2. A golf training aid according to claim 1, wherein the plurality of poles comprises four poles, two positionable at an entry point of the swing and two positionable at an exit point of the swing.

3. A golf training aid according to claim 1, wherein the poles are each angled relative to the U-shaped base.

4. A golf training aid according to claim 1, wherein the poles are each angled relative to the U-shaped base at an angle from 44 degree to 65 degrees.

5. A golf training aid according to claim 1, wherein the poles are made of a material that provides feedback when hit by a golf club without damaging the golf club.

6. A golf training aid according to claim 1, wherein the plurality of poles comprising a first set of poles angled relative to the U-shaped base at a first angle and a second set of poles angled relative to the U-shaped base at a second angle different than the first angle.

7. A golf training aid for practicing swings, the golf training aid comprising:

a U-shaped base having a first arm and a second arm parallel to the first arm, the first arm and second arm being connected at a connecting portion to form a U-shaped structure having an open interior between the first arm and the second arm so that when the base is placed on the ground, the ground is exposed within the open interior, and a plurality of poles, each pole having a base selectively attachable to the U-shaped base, wherein the U-shaped base includes a target line, a pair of external pole-positioning lines, and a pair of interior pole-positioning lines inside and parallel to the external pole-positioning lines, wherein the poles are attachable to the U-shaped base at a first position when swings are to be practiced to make a first slot to swing through and wherein the poles are attachable to the U-shaped at a different position laterally to make a different slot to swing through.

8. A golf training aid according to claim 7, wherein the plurality of poles comprises four poles, two positionable at an entry point of the swing and two positionable at an exit point of the swing.

9. A golf training aid according to claim 7, wherein the poles are each angled relative to the U-shaped base.

10. A golf training aid according to claim 7, wherein the poles are each angled relative to the U-shaped base at an angle from 44 degree to 65 degrees.

11. A golf training aid according to claim 7, wherein the poles are made of a material that provides feedback when hit by a golf club without damaging the golf club.

12. A golf training aid according to claim 7, wherein the plurality of poles comprising a first set of poles angled relative to the U-shaped base at a first angle and a second set of poles angled relative to the U-shaped base at a second angle different than the first angle.

13. A golf training aid for practicing swings, the golf training aid comprising:

a U-shaped base having a first arm and a second arm parallel to the first arm, the first arm and second arm being connected at a connecting portion to form a U-shaped structure having an open interior between the first arm and the second arm so that when the base is placed on the ground, the ground is exposed within the open interior, and a plurality of poles, each pole having a base selectively attachable to the U-shaped base, wherein the U-shaped base includes a target line, a pair of external pole-positioning lines, and a pair of interior pole-positioning lines inside and parallel to the external pole-positioning lines, wherein the poles are attachable to the U-shaped base along the interior pole-positioning lines or along the exterior pole-positioning lines when swings are to be practiced, and wherein the width of the U-shaped base is at least 305 mm at an end opposite the connecting portion.

14. A golf training aid according to claim 13 wherein the width of the U-shaped base is at least 305 mm at the end adjacent to the connecting portion.

15. A golf training aid according to claim 13 wherein the internal pole-positioning lines extend the length of the U-shaped base.

16. A golf training aid according to claim 13 wherein the external pole-positioning lines extend the length of the U-shaped base.

* * * * *